US007150086B2

(12) United States Patent
Rapp

(10) Patent No.: US 7,150,086 B2
(45) Date of Patent: Dec. 19, 2006

(54) TOOL THAT CONNECTS PIECES THROUGH A PROCESS OF RIVETING

(76) Inventor: Eugen Rapp, Max-Reger-Strasse 4, Berg (DE) 88276

( * ) Notice: Subject to any disclaimer, the term of this patent is extended or adjusted under 35 U.S.C. 154(b) by 157 days.

(21) Appl. No.: 10/472,579

(22) PCT Filed: Apr. 4, 2001

(86) PCT No.: PCT/DE02/01227

§ 371 (c)(1),
(2), (4) Date: Apr. 26, 2004

(87) PCT Pub. No.: WO02/081112

PCT Pub. Date: Oct. 17, 2002

(65) Prior Publication Data

US 2004/0170473 A1 Sep. 2, 2004

(30) Foreign Application Priority Data

Apr. 4, 2001 (DE) ..... 101 16 692

(51) Int. Cl.
*B23P 11/00* (2006.01)

(52) U.S. Cl. ..... 29/432.2; 29/283.5; 29/505; 29/524.1; 72/396

(58) Field of Classification Search ..... 29/21.1, 29/243.5, 283.5, 505, 509, 524.1, 798, 432.2; 72/395, 396, 465.1, 481.1, 481.3, 481.6, 72/481.7

See application file for complete search history.

(56) References Cited

U.S. PATENT DOCUMENTS

| | | | | |
|---|---|---|---|---|
| 4,459,735 | A * | 7/1984 | Sawdon | 29/509 |
| 4,757,609 | A * | 7/1988 | Sawdon | 29/798 |
| 4,910,853 | A * | 3/1990 | Sawdon | 29/283.5 |
| 5,027,503 | A * | 7/1991 | Sawdon | 29/798 |
| 5,150,513 | A * | 9/1992 | Sawdon | 29/798 |
| 5,177,861 | A * | 1/1993 | Sawdon | 29/798 |
| 5,208,973 | A * | 5/1993 | Sawdon | 29/798 |
| 5,208,974 | A * | 5/1993 | Sawdon et al. | 29/798 |
| 5,267,383 | A * | 12/1993 | Sawdon | 29/243.5 |
| 5,339,509 | A * | 8/1994 | Sawdon et al. | 29/432 |
| 5,435,049 | A * | 7/1995 | Sawdon | 29/243.5 |
| 5,479,687 | A * | 1/1996 | Sawdon | 29/243.5 |
| 5,490,310 | A * | 2/1996 | Schleicher | 29/243.5 |
| 5,509,290 | A * | 4/1996 | Faivre | 72/395 |
| 5,581,860 | A * | 12/1996 | Sawdon | 29/243.5 |
| 5,709,019 | A * | 1/1998 | Sawdon | 29/243.5 |
| 5,727,302 | A * | 3/1998 | Sawdon | 29/436 |
| 5,737,819 | A * | 4/1998 | Sawdon et al. | 29/243.5 |
| 5,946,782 | A * | 9/1999 | Dubugnon et al. | 29/21.1 |
| 5,984,563 | A * | 11/1999 | Wu | 403/282 |
| 5,992,206 | A * | 11/1999 | Kuhne | 72/395 |
| 6,092,270 | A * | 7/2000 | Sawdon | 29/243.5 |
| 6,612,007 | B1 * | 9/2003 | Wade | 29/243.5 |

FOREIGN PATENT DOCUMENTS

| | | |
|---|---|---|
| DE | 3210208 | 9/1983 |
| DE | 4435460 | 4/1996 |
| EP | 0835701 | 4/1998 |
| GB | 2069394 | 8/1991 |
| WO | 9702912 | 1/1997 |

* cited by examiner

*Primary Examiner*—Essama Omgba
(74) *Attorney, Agent, or Firm*—Orum & Roth LLC

(57) ABSTRACT

A tool, for making clinching connections, which has a multi-part matrix with matrix sheathing pieces that move to the outside and with counteracting springs. These springs are one-piece connected with each other through a connecting section. There are at least three sheathing pieces which are arranged axially symmetric around the centerline of the matrix.

20 Claims, 1 Drawing Sheet

Fig.1
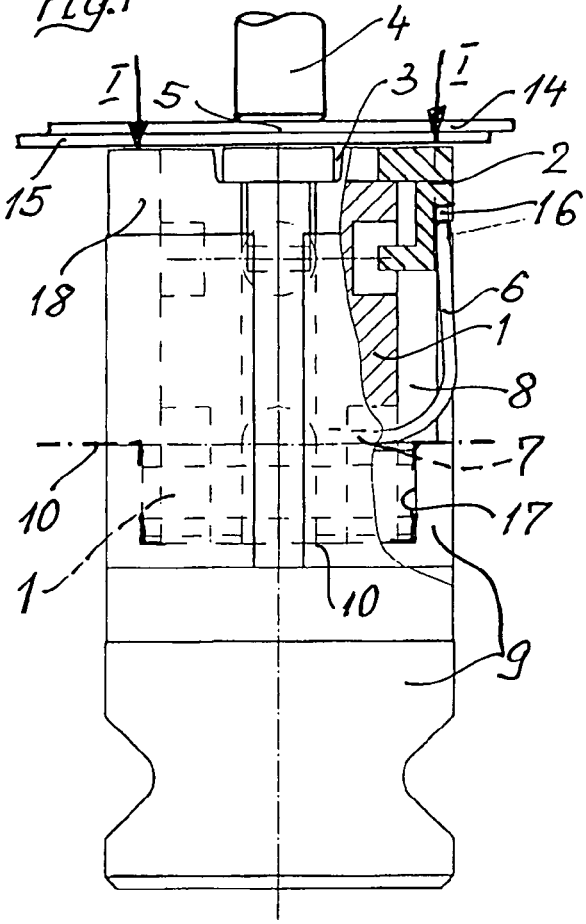
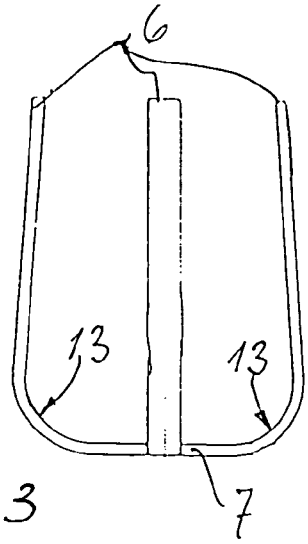
Fig.3
Fig.4
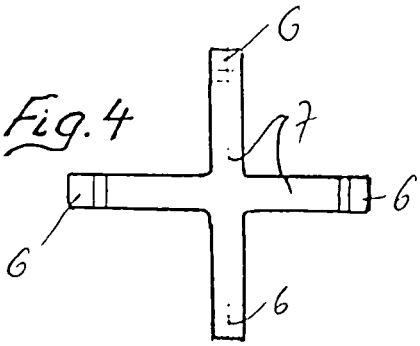
Fig.2
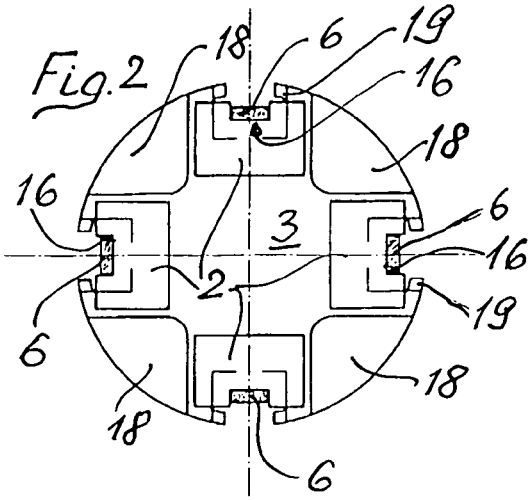
Fig.5
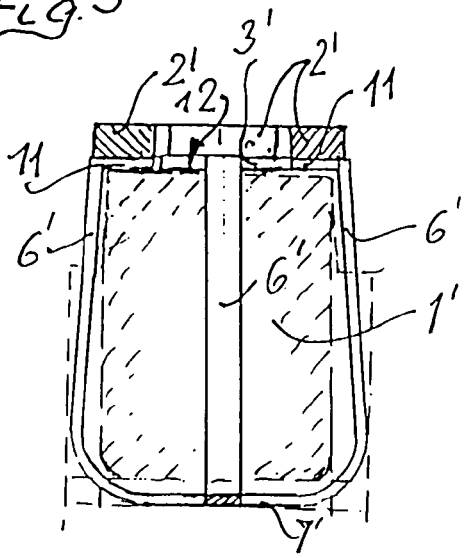

TOOL THAT CONNECTS PIECES THROUGH A PROCESS OF RIVETING

The present application claims priority to PCT/DE02/01227 filed 04 Apr. 2002 and DE10116692.3 filed 04 Apr. 2001.

BACKGROUND OF THE INVENTION

1. Field of the Invention

A tool that connects plates or plate pieces that are overlapping, or plates with connecting points (punching rivets, screw bolt attachments, or the like) through the process of riveting (clinching, or the like).

2. Description of Related Art

According to a known tool (DE 44 35 460, FIG. 3), the sheathing pieces of the matrix, radially outward flexible, are moved against the force of spring plates. At the same time, these spring plates serve the purpose of attaching the matrix pieces to the matrix body. To this end, the matrix pieces are bolted at one end to the matrix body, and at the other end, they are bent and slide into the grooves of the corresponding sheathing pieces. There is also a flexible belt between the spring plates and the matrix pieces for the purpose of giving additional support and guidance to the matrix pieces. One disadvantage is the fact that this spring arrangement is a disturbance factor. Since these heavy-duty tools are exposed to rough conditions, the springs can loosen, which in turn can result in defective connecting points. In addition, it can require expensive reworking measures or the replacement of work pieces, since the automatic manufacturing does not allow for an immediate assessment of the defects. The other disadvantage is the fact that the installation of the tool, the mounting of the spring plates, as well as the setting up of the sheathing pieces is difficult and complex and, consequently, expensive.

There is another known tool of the same kind (EP 0744231 B1) in which, through the work piece material that is displaced between punch and base plate, two sheathing pieces placed opposite to each other are pushed apart against the force of the corresponding spring. The springs have a connecting section which runs transverse to the driving direction and is located in a groove underneath the base plate of the matrix. During the working process, with the aid of the spring-loaded sheathing pieces, the plates that have to be connected are first partly punched and then compressed. In this way, during the process of compression, some of the partly punched plates can move transverse to the direction of the sheathing pieces. Apart from the fact that, as a result of the punching, the plates are not connected tightly, this connection is also less durable than the connection made with the above-mentioned clinching tool. However, the reset springs of the sheathing pieces are also exposed to less pressure so that such a simple multi-cranked leaf spring could be used. It is also very easy to remove the work piece from the tool. But this tool is not able to make a clinching connection without cutting through the plate, not even if adjustments are made. However, this is also not intended since the connections are made with a completely different procedure.

Another known tool (EP 0835701 A 2) provides only two expanding pieces as alternatable sheathing pieces, which are held in place with metal springs. The two springs are connected with casing rings. Even in this case, the springs are only exposed to the pressure of two sheathing pieces placed opposite to each other. Therefore, it is actually not possible to monitor the displaced plates and their movement.

Another known tool (PCT-WO 97/029 12, DE 32 10 208) has a spring ring around the sheathing pieces which opens during the clinching process and the movement of the sheathing pieces. Even in this case, there is the disadvantage that the ring presents a disturbing factor, especially in the form of wear debris and the like, which can result in early wear-out. In addition, during the working process with this tool, the plates are partly clinched.

There is yet another tool (GB 2069394) in which the sheathing pieces of the matrix are connected in one piece with the matrix on the side opposite to the punch. Like a cantilever, they take on the work of the spring. The disadvantage of this tool is especially its high production costs as well as its lack of flexibility.

SUMMARY OF THE INVENTION

The tool has the advantage that there is not going to be any clinching of the plates and, consequently, there will also not be any loose connecting points. Therefore, the inventive tool is well suited for use in clinching procedures in which there is a controlled movement or the displaced plates because of the symmetrical arrangement along the centerline and because of the use of more than two flexible sheathing pieces. With a simple bar or leaf spring, which is extremely easy to house within the tool, sufficient force is provided to reset the sheathing pieces. This tool makes very good connecting points, and it is extremely inexpensive to produce. It is also quite robust and easy to mount. In case of a crosswise or star-shaped structure, the corresponding connecting sections intersect, or they are at least able to intersect. If the structure is circular, the springs branch off radially. Therefore, it is not art encompassing casing ring, but a disk that is located in the dividing plane of the matrix.

One useful design of the invention is the fact that the crank has a minimum radius of 10 percent of the matrix diameter. As is generally known, the durableness and effectiveness of the leaf spring greatly depend on its formation at the bearing point, where in contrast to a minimum radius, it is more likely that a bending point will result in a break of the springs.

Another useful design of the invention is the fact that, as demonstrated (in EP 0744231 B 1), the springs and their connecting sections are made from flats. This leaf-spring-like material is very easy to produce. It is possible to punch spring and connecting section in one piece. Afterward, it is cranked and cured. It is also very easy to mount.

A further useful design of the invention is the fact that the matrix is divided transverse to the driving direction in order to make the dividing plane; that is, the front side facing away from the working opening serves as dividing plane of the base plate.

A further useful design of the invention is the fact that the matrix base is formed like a bearing box in which the sheathing pieces are mounted and running. At the front side, the side facing away from the punch, the connecting pieces of the springs are supported.

A further useful design of the invention is the fact that there are radial and/or frontal grooves in the matrix base plate for the purpose of placing the springs or connecting sections. In these grooves, the sheathing pieces, springs, and connecting sections are housed in a way that one more or less smooth, cylindrical matrix is formed, which cannot easily be damaged. It is also easy to exchange in the machine tool.

A further useful design of the invention is the fact that the sheathing pieces are non-detachably connected with the free ends of the springs. These sheathing pieces are, for instance, supported on the matrix base plate at the side facing away from the punch in order to produce a counter acting force through the clinching force caused by the punch. As a result of the cleavage, they slide on the base plate radially outward, in each case against the force of the spring.

A further useful design of the invention is the fact that the sheathing pieces are attached to the sections by means of soldering, welding, or the like.

A further useful design of the invention is the fact that the free ends of the springs are bent to the inside in the direction of the working opening. The surfaces of the bent sections of the springs pointing to the direction of the punch serve as support for the sheathing pieces mounted there. In this way, comparatively small surfaces can house relatively wide sheathing pieces, especially if these sheathing pieces restrict the working opening radially.

A further useful design of the invention is the fact that the dividing plane runs between the base plate and a socket into which the machine tool is placed. Consequently, as mentioned above, a completely self-contained tool is produced.

A further useful design of the invention is the fact that there is a device between socket and base plate for the purpose of connecting the pieces. This connection of base plate and socket well secures the arrangement of the springs.

A further useful design of the invention is the fact that the connecting device consists of connection pins, or the like. In addition to forming a connection, this also fixes the two pieces with regard to their rotating position.

A further useful design of the invention is the fact that the volume dimensions of punch and working opening are adapted to the displaced material. Several sections of partition walls are fixed around the circumference of the working opening. The sections in between these walls are designed as alternatable pieces. In this way, the sheathing pieces can form completely the radial wall of the working opening, or they can form parts of the opening, leaving other parts in place, depending on the intended structure of the connecting knot.

A further useful design of the invention is the fact that the radial way of the alternatable sheathing pieces is rigidly restricted through blocks of the matrix. This provides cold compression for the displaced material and, as a result, considerably increases the strength of the connecting point. In addition, such blocks protect the sheathing pieces from falling out and the springs from over-expanding.

A further useful design of the invention is the fact that the punch is made in the form of a rivet, nut, bolt, or the like, in order to remain positive-fit and/or friction-locked in the resulting cupping opening after the clinching process is finished. This material bond gives an additional stability to the connection so that the cupping opening is completely positive-fit and the connecting point can no longer unlock.

Further advantages and useful designs of the invention are explained in the following descriptions, figures, and claims.

BRIEF DESCRIPTION OF THE FIGURES

Two variations of the embodiment of the invented tool are illustrated and explained in further detail in the following figures:

FIG. 1 Longitudinal section of the connecting tool

FIG. 2 Top view according to line I—I in FIG. 1

FIG. 3 Lateral view of the spring arrangement

FIG. 4 Top view of the spring arrangement in FIG. 3

FIG. 5 A variation of the spring arrangement or matrix

DETAILED DESCRIPTION OF THE INVENTION

As depicted with the tool in FIG. 1, which is designed to connect plates and the like, several sheathing pieces (2) are mounted in the base plate (1) of the matrix with their upper free end radially outward alternatable. Through these sheathing pieces (2) and the matrix base plate (1), a working opening is defined in which, by means of a punch (4), areas (5) of plates (14 and 15) that have to be connected are pressed. In this way, a clinching connection is made. In order to improve the engagement of the deep-drawn and, afterwards, radially compressed plate section (5), in this clinching process, the matrix sheathing pieces (2) yield radially outward, contrary to the force of the springs (6). These springs are one-piece connected through a connecting section (7) on the side of the matrix base plate facing away from the working opening (3). For the protection and guidance of the matrix sheathing pieces (2), the springs (6), and the connecting sections (7), grooves (8) are located in the matrix base plate. In this way, it is easy to mount the matrix flush into the appropriated opening of the machine tool, and the sheathing pieces or spring parts are not interfering.

The base plate (1) is connected to a socket (9)—which is not shown in the figure—which covers the grooves (8) in which the connecting section (7) is located. In this way, the spring arrangement is secured in the matrix, bringing about a completely self-contained tool which, in its dimensions, matches the dimensions of the machine tool for which it is designed. Between the matrix base plate (1) and the socket (9) there is a dividing plane. According to the invention, after inserting the spring, the matrix base plate is pressed into a corresponding recess (17) of the socket (9).

In order to achieve an exact guidance between the matrix sheathing piece (2) and the free end of the springs (6) and, in connection with this guidance, provide the free end of the spring with the required mobility, a longitudinal groove (16) incorporating the spring (6) is located at the backside of the sheathing pieces (2) facing the spring (6).

In addition, for their alternatable movement, the sheathing pieces (2) are guided in fixed sections. To this end, these sections (18) are connected to the matrix base plate (1) or socket (9) in the direction of the punch (4). At the socket (9), there are blocks (19) which restrict the mobility of the sheathing pieces (2). As a result, during the production process and the corresponding displacement of the work piece, a cold forming of the now compressed material takes place when the sheathing pieces (2) push against the blocks (19) and the punch (4) continues its lifting movement.

FIGS. 3 and 4 show a simple spring arrangement, forming a cross which consists of a crosswise connecting section (7) and the springs (6) located there. The springs (6) have cranks (13) in driving direction of the punch across from the connecting section (7). This spring arrangement consisting of four springs activates four sheathing pieces. The number of sheathing pieces corresponds to the number of free springs, so that the connecting section can take the form of a cross, be star-shaped, or the like.

As shown in FIG. 5, the springs (6') are bent at the top towards the inside, producing sections (11), on the surface of which matrix sheathing pieces (2') are mounted. These sheathing pieces have the same function as in FIG. 1 but are constructed completely different. They are constructed in a way that their sheathing pieces (2') restrict the working opening (3) radially towards the inside. Apart from that, however, these sheathing pieces, including the bent sections (11) of the springs (6'), are supported at the surface of the Matrix base plate (1') in order to absorb the clinching force of the punch. During the clinching procedure, the sheathing pieces (2') move radially to the outside. The matrix base plate (1') is only represented in a dotted line in order to be able to show, from a top view, the spring (6') or sheathing piece (2') on the backside. In this view, the front spring is not shown.

All characteristics represented in the description, the following claims, and figures are significant for the invention, separately as well as in any form of combination.

REFERENCE LIST

1 Matrix base
2 Matrix sheathing pieces
3 Working opening
4 Punch
5 Areas
6 Springs
7 Connecting sections
8 Grooves
9 Sockets
10 Dividing plane
11 Sections
12 Surfaces
13 Cranks
14 Plates
15 Plate
16 Longitudinal groove
17 Recess
18 Sections
19 Block

The invention claimed is:

1. A tool that connects plates or plate pieces placed on top of each other, or plates with connecting points comprising:
- a matrix having a working opening,
- a punch, powered in the direction of the working opening,
- a matrix base plate positioned across from the punch,
- at least three matrix sheathing pieces arranged radially around the working opening, said sheathing pieces adapted to move radially outward during a clinching procedure, said sheathing pieces being restricted in movement by displaced work pieces, and
- said sheathing pieces are mounted in the matrix base plate,
- said matrix base plate comprises:
  - bar-shaped springs operating radially inward of sides that engage the sheathing pieces, at a first end the springs engage the sheathing pieces, at a second end the springs are one-piece connected with each other through a connecting section in a crank for each spring in the direction of the sheathing pieces,
  - in a transition area between the connecting section and the springs said connecting section located at a dividing plane of the matrix which runs transverse to a driving direction,
- said sheathing pieces are mostly arranged axially symmetric around a centerline of the matrix and
- the connecting sections take the form of a cross, ring-shaped or star-shaped,
- wherein during the clinching procedure, the punch does not cut through the plate.

2. A tool according to claim 1, wherein the crank has a minimum radius of 10% of a diameter of the matrix.

3. A tool according to claim 2, characterized by the fact that the springs are leaf springs.

4. A tool according to claim 2, wherein a front face of the base plate facing away from the working opening serves as dividing plane.

5. A tool according to claim 2, wherein the matrix base plate is formed as a bearing support by mounting the sheathing pieces so that the sheathing pieces can be tilted or adjusted and arranging the connecting section at the side opposite to the working opening.

6. A tool according to claim 2, further comprising grooves or recesses lengthwise and/or at the front of the matrix base plate adapted to receive the sheathing pieces, the springs, and the connecting section.

7. A tool according to claim 1, wherein the springs are leaf springs.

8. A tool according to claim 1, wherein the front face of the base plate facing away from the working opening serves as dividing plane.

9. A tool according to claim 1, wherein the matrix base plate is formed as a bearing support by mounting the sheathing pieces so that the sheathing pieces can be tilted or adjusted and the connecting section is arranged at the side opposite to the working opening.

10. A tool according to claim 1, further comprising grooves or recesses lengthwise and/or at the front of the matrix base plate adapted to receive the sheathing pieces, the springs, and the connecting section.

11. A tool according to claim 1, wherein free endings of the springs are connected to the sheathing pieces.

12. A tool according to claim 11, wherein the sheathing pieces and the springs are connected with longitudinal grooves in which the free endings of the springs are adjustable.

13. A tool according to claim 11, wherein the endings of the springs are bent to the inside, a surface areas pointing to the punch, and the bent endings of the free springs support the sheathing pieces.

14. A tool according to claim 1, further comprising socket pieces,
- wherein the dividing plane runs between the base plate and one of the socket pieces to be placed into a machine tool, and the matrix base plate is capable of being pressed into a recess of the one socket piece.

15. A tool according to claim 14, further comprising a connection between a socket piece and the base plate made with a part-connecting device.

16. A tool according to claim 15, wherein the part-connecting device comprises connection pins.

17. A tool according to claim 1, further comprising
- a plurality of sections of partition walls fixed around the circumference of the working opening, sections in between said partition walls are alternative sheathing pieces ajustable to the dimensions of the punch.

18. A tool according to claim 1, wherein a radial line of an exchangeable sheathing piece is restricted through blocks of the matrix.

19. A tool according to claim 18, wherein the blocks are connected to socket pieces.

20. A tool according to claim 1, wherein the punch is selected from the group consisting of a rivet, nut, bolt, to remain positive-fit and/or friction-locked in a resulting cupping opening after completion of the clinching.

* * * * *